US005355817A

United States Patent [19]

Schrems

[11] Patent Number: 5,355,817

[45] Date of Patent: Oct. 18, 1994

[54] SAIL BOAT

[76] Inventor: James M. Schrems, 8650 Ederer Rd., Saginaw, Mich. 48609

[21] Appl. No.: 128,551

[22] Filed: Sep. 29, 1993

[51] Int. Cl.[5] ..... B63H 9/08

[52] U.S. Cl. ..... 114/39.1; 114/102; 114/61; 114/153; 114/363

[58] Field of Search ..... 114/39.1, 102, 103, 114/104, 363, 61, 153; 254/358

[56] References Cited

U.S. PATENT DOCUMENTS

| | | | |
|---|---|---|---|
| 3,331,349 | 7/1967 | Oglesby | 254/358 X |
| 4,276,033 | 6/1981 | Krovina | 440/8 |
| 4,296,704 | 10/1981 | Bridge | 114/103 |
| 4,408,772 | 10/1983 | Hollwarth | 114/61 X |
| 4,497,272 | 2/1985 | Veazey | 114/103 |
| 4,539,926 | 9/1985 | Boffer | 114/363 X |
| 4,738,414 | 4/1988 | McCulloh | 114/61 X |
| 4,936,236 | 6/1990 | Sinden | 114/103 |
| 4,979,458 | 12/1990 | Bouza | 114/363 |

FOREIGN PATENT DOCUMENTS

| | | | |
|---|---|---|---|
| 0312129 | 4/1989 | European Pat. Off. | 114/61 |
| 3835551 | 4/1990 | Fed. Rep. of Germany | 114/61 |
| 2098947 | 12/1982 | United Kingdom | 114/39.1 |
| 2098948 | 12/1982 | United Kingdom | 114/39.1 |
| 2098950 | 12/1982 | United Kingdom | 114/39.1 |

*Primary Examiner*—Sherman Basinger
*Attorney, Agent, or Firm*—Learman & McCulloch

[57] ABSTRACT

A wind-powered boat has a pair of spaced apart, fixed hull sections and a castering front hull between the side hull sections. A turret section is supported for rotation on the boat and has a foot-powered winch on which a load line and a pair of control lines of a maneuverable parafoil are wound. Hand-manipulated control reins engage the control lines for maneuvering the parafoil. A foot-operated steering mechanism controls movement of the rudder to steer the boat. A collapsing ring is slideable over the parafoil for collapsing and supporting the parafoil when retrieved. A launching ring releasably supports the parafoil until it is launched.

26 Claims, 8 Drawing Sheets

SAIL BOAT

TECHNICAL FIELD

This invention relates generally to wind-powered water craft and more particularly to boats having a mastless parachute-type airfoil as the primary means of driving the boat.

BACKGROUND OF THE INVENTION

Various wind-powered water craft have been developed in the recent past utilizing a parafoil as the prime mover. Such water craft in general has potential significant advantages over conventionally rigged sailing craft in that the parafoil is able to be extended 50–150 feet or more above the boat into winds that are 15–30% higher in velocity than winds near the surface and less turbulent. Consequently, significantly greater speed is realized with parafoil rigging.

There are, however, also significant disadvantages associated with known parafoil-powered water craft and in particular the ability of a single person to launch, maneuver, and control the kite while controlling the direction of the boat itself.

SUMMARY OF INVENTION

According to a preferred embodiment of the invention, a wind-powered boat is provided having a parafoil as the primary mover and includes launching means detachably coupled to a top of the parafoil for suspending the parafoil above the boat and presenting it to the wind for launching, line length adjusting means for enabling the parafoil to be moved toward or away from the boat during use, hand-operated control means for maneuvering the parafoil during flight, foot-operated rudder control means for steering the boat independently of the parafoil, and parafoil landing means for landing and supporting the parafoil once retrieved.

The apparatus is constructed to allow a single person to launch, control, and retrieve the parafoil while maneuvering the boat. Such features are not known to have been provided heretofore in a single parafoil-powered craft.

BRIEF DESCRIPTION OF THE DRAWINGS

Apparatus constructed according to the invention is illustrated in the accompanying drawings, wherein.

DETAILED DESCRIPTION

Figure 1A:
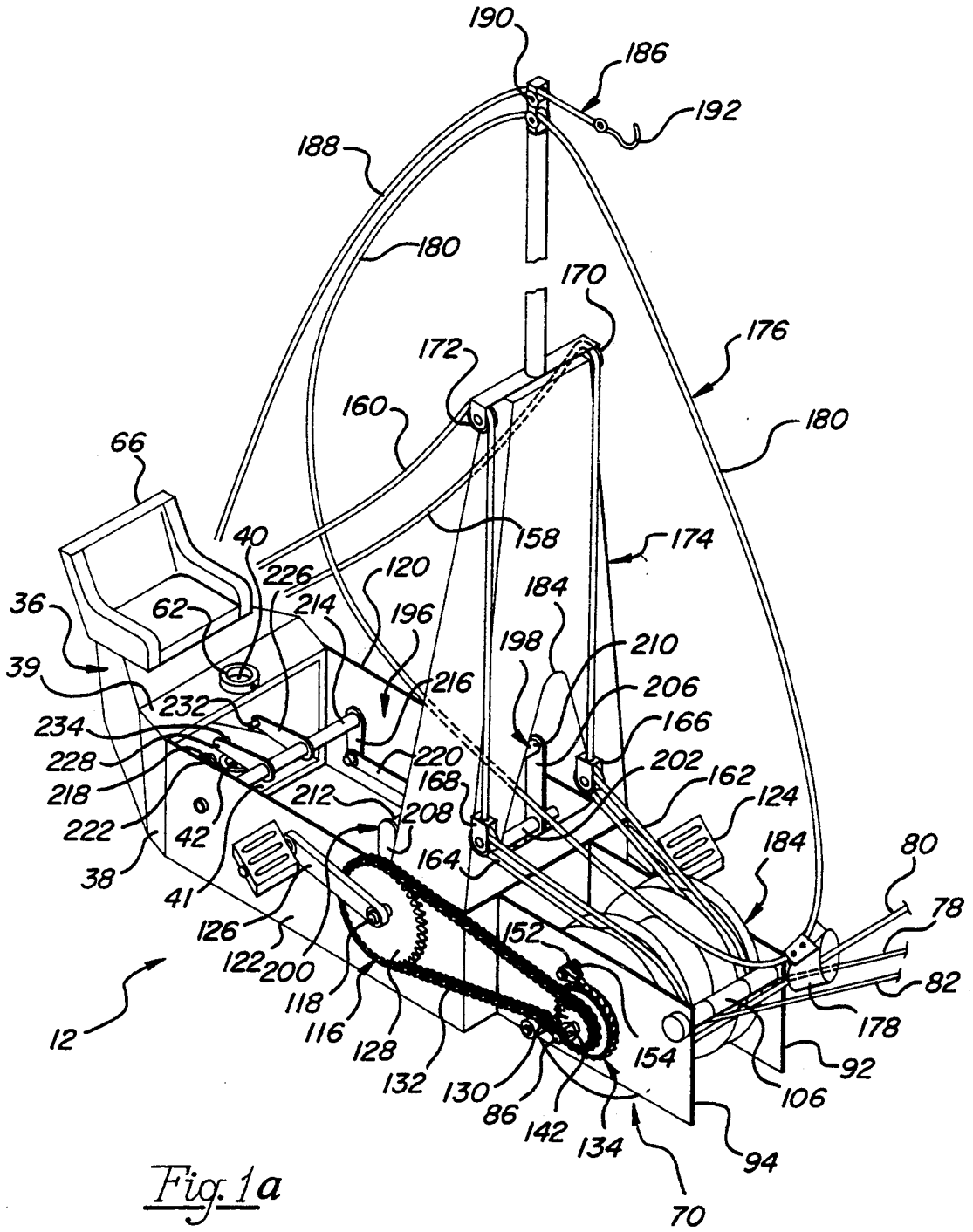
FIGS. 1*a* and 1*b* together constitute a fragmentary, perspective view of the upper turret section of the boat and parafoil apparatus.
Figure 1B:
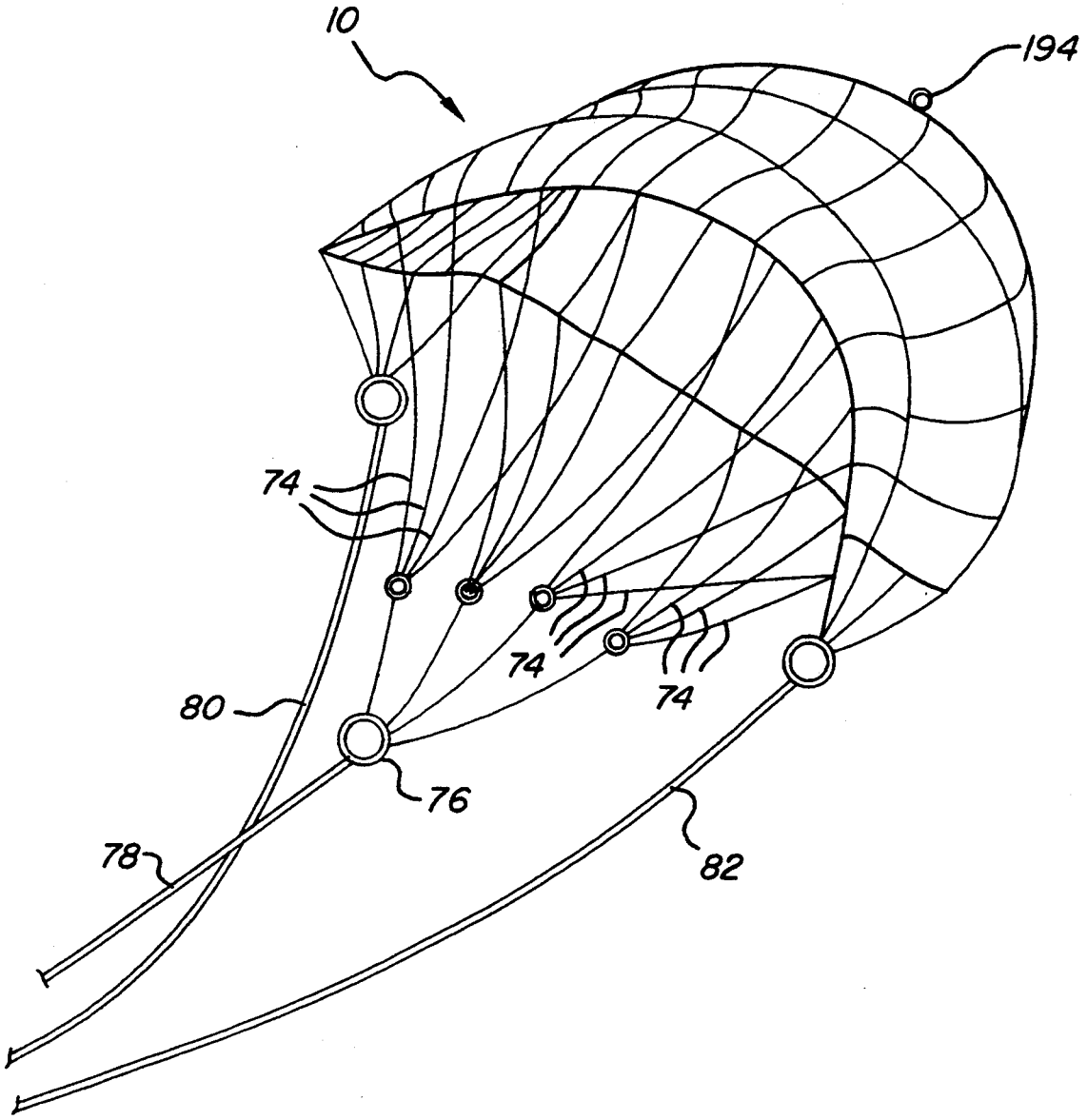
Figure 2:
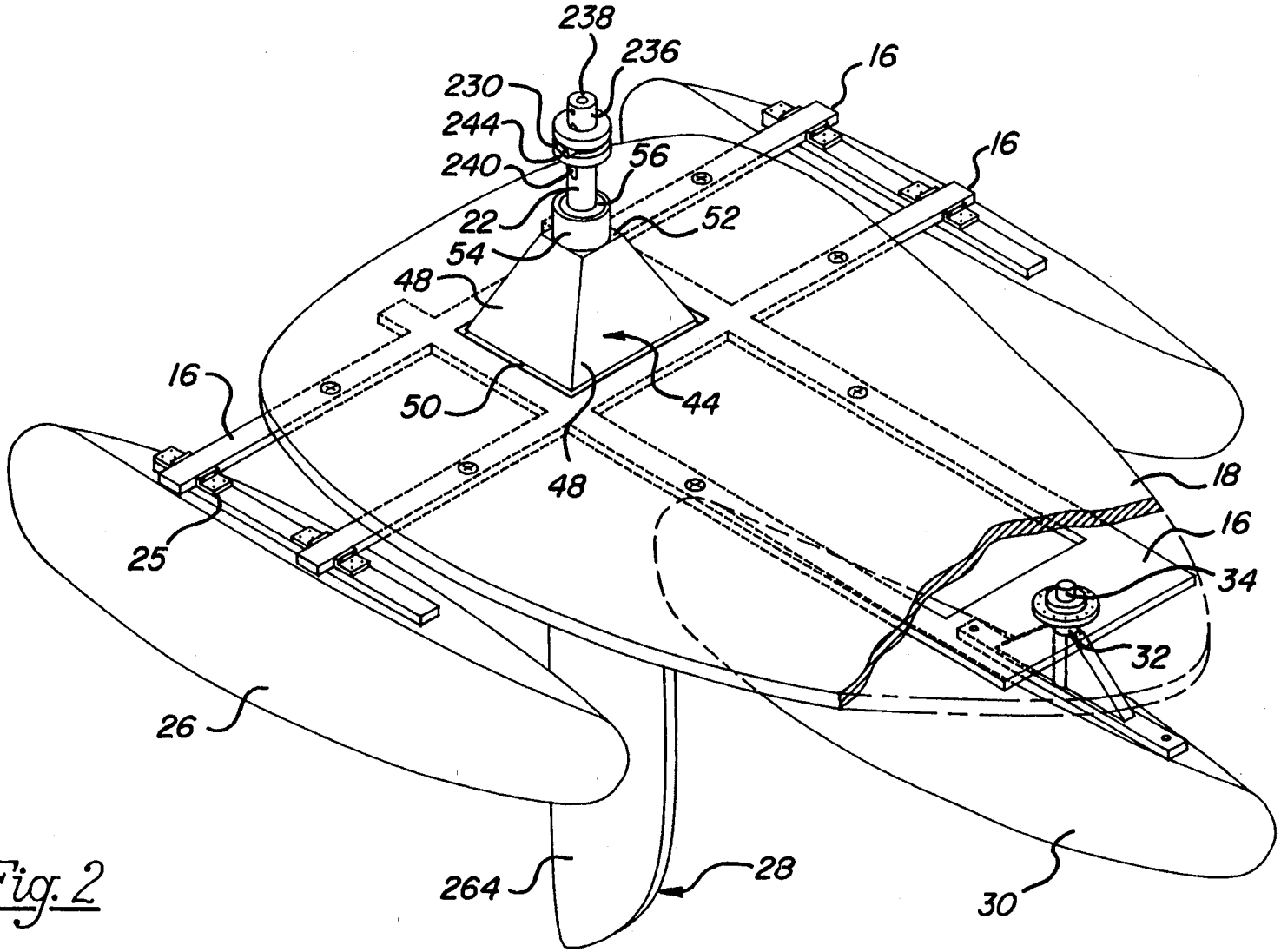
FIG. 2 is a fragmentary perspective view of the base section of the boat.
Figure 3:
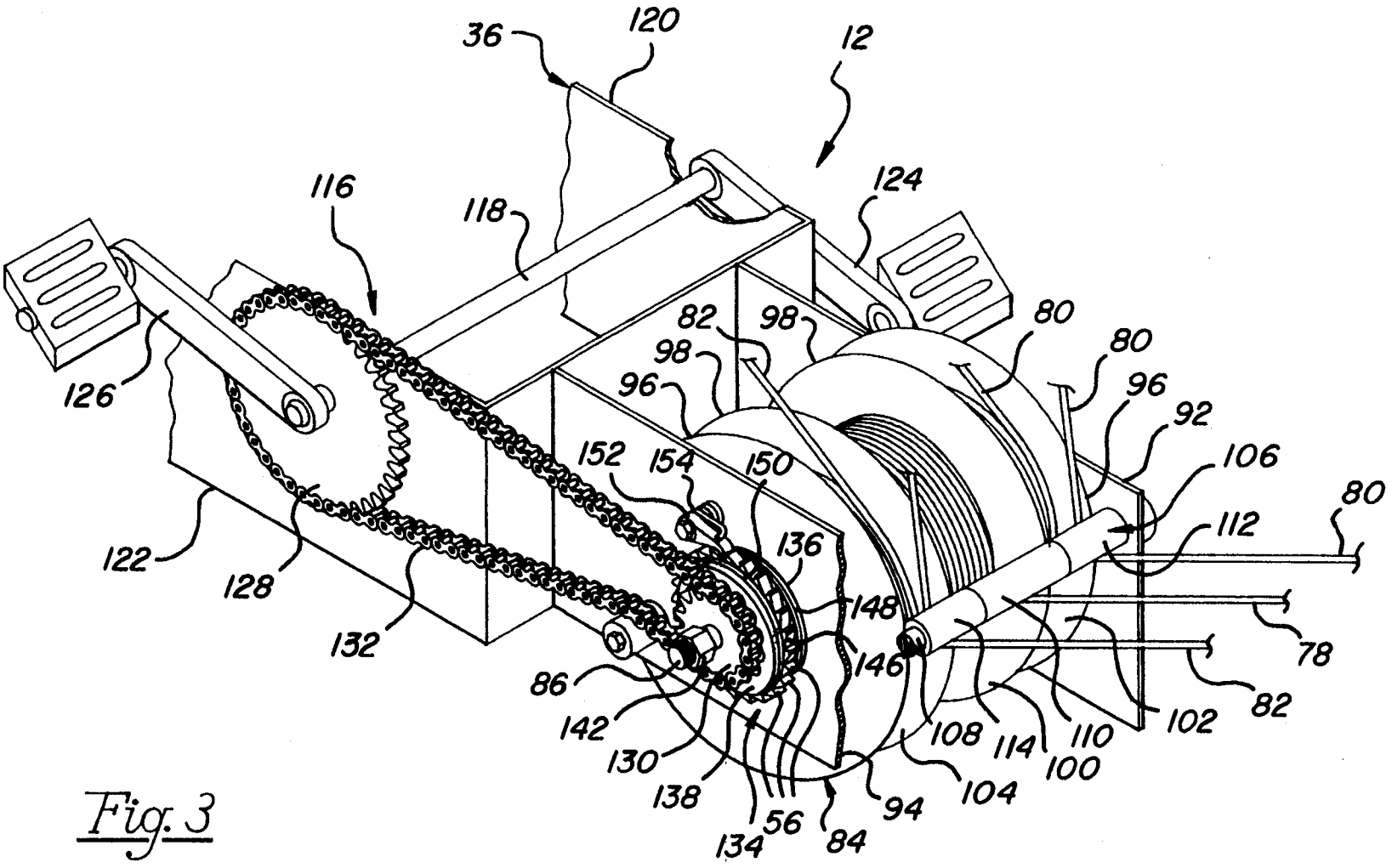
FIG. 3 is a fragmentary perspective view of the winch and crank assembly, but with the rudder steering pedal assembly removed.
Figure 4:
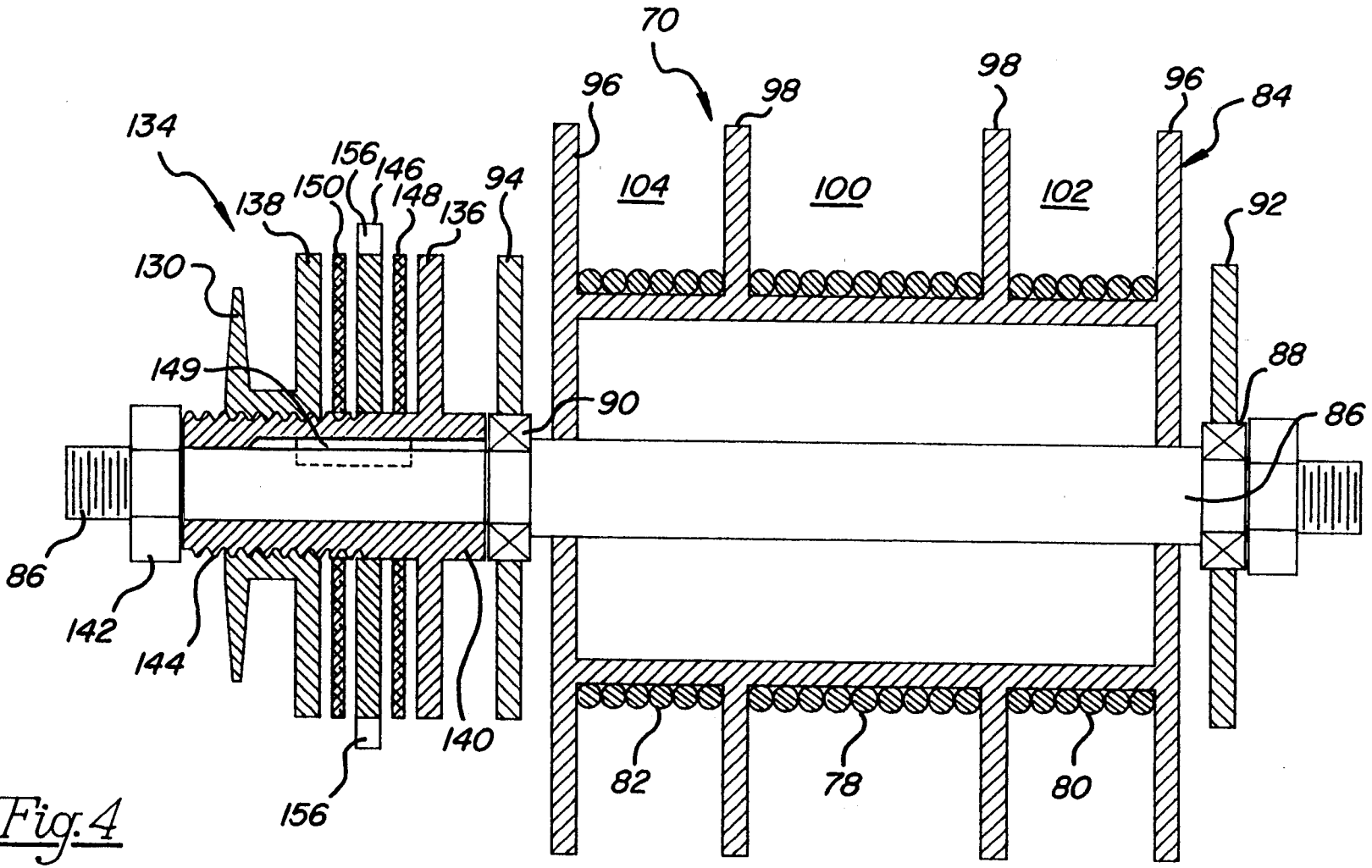
FIG. 4 is a sectional view of the automatic brake and drum assembly.

A wind-powered sailing craft constructed according to a presently preferred embodiment of the invention is shown in FIGS. 1 and 2 and comprises a kite boat having a parafoil 10 tethered to an upper turret portion 12 which in turn is supported rotatably on a lower base portion 14 of the boat.

The base portion 14 includes a rigid aluminum or other suitable frame 16 and supporting a rigid board-like platform 18 formed of fiberglass, wood, or other suitable material mounted on the frame 16 by bolts or other suitable fasteners. A turret pedestal assembly 20 is secured to the frame 16 and extends above the platform 18 for supporting the turret section 12 above the platform 18 and enabling the turret section 12 to rotate freely on the pedestal assembly 20 in a generally horizontal plane relative to the base section 14.

The base frame 16 mounts a pair of laterally spaced buoyant hulls 24 and 26. The hulls 24 and 26 extend lengthwise of the base section 14 on opposite sides of the platform 18 and are fixed to the frame 16 by brackets 25 of other suitable means. The hulls may have any selected one of a number of different configurations common to hulled sailing vessels but are preferably designed to offer minimum drag as the apparatus travels through the water. The hulls 24 and 26 have a rigid outer shell of fiberglass or equivalent material enclosing a chamber that either may be left empty or filled with closed cell foam material, such as polystyrene.

The frame 16, the platform 18, and the hulls 24 and 26 may comprise separate components, as described, or may be fabricated as a one piece integral structure out of metal or molded composite material.

The base portion 14 has a steerable rudder 28 extending beneath the platform 18 between the hulls 24 and 26 to enable an operator to steer the base portion as it travels through the water. A buoyant free-castering front hull 30 is mounted on the front of the base 14 between the hulls 24 and 26 and is freely rotatable on the base allowing the base section to change direction with little resistance. As shown in FIG. 2, the front hull 30 is secured to the frame 16 by a pivot connection 32 enabling hull 30 to caster freely about a generally vertical axis of a pivot pin 34. The pin 34 is mounted nearer to the front end of the hull 30 and forwardly of the balancing point of the hull so that the hull is pulled along by the pivot 32 rather than being pushed thereby allowing the hull 30 to respond quickly and effortlessly to movements of the rudder 28 and oppositely of the rudder to assist in changing direction of the base 14 with little resistance to turning. The front hull 30 is of the same construction as the hulls 24 and 26.

The turret section 12 has an elongate box-like frame 36 formed of aluminum, fiberglass, or other suitable rigid material. The frame 36 has a turret bearing housing 38 adjacent the rear of the frame 36 which has top and bottom walls 39 and 41 provided with a pair of vertically aligned apertures 40 and 42, respectively, accommodating turret pin 22.

Figure 7:
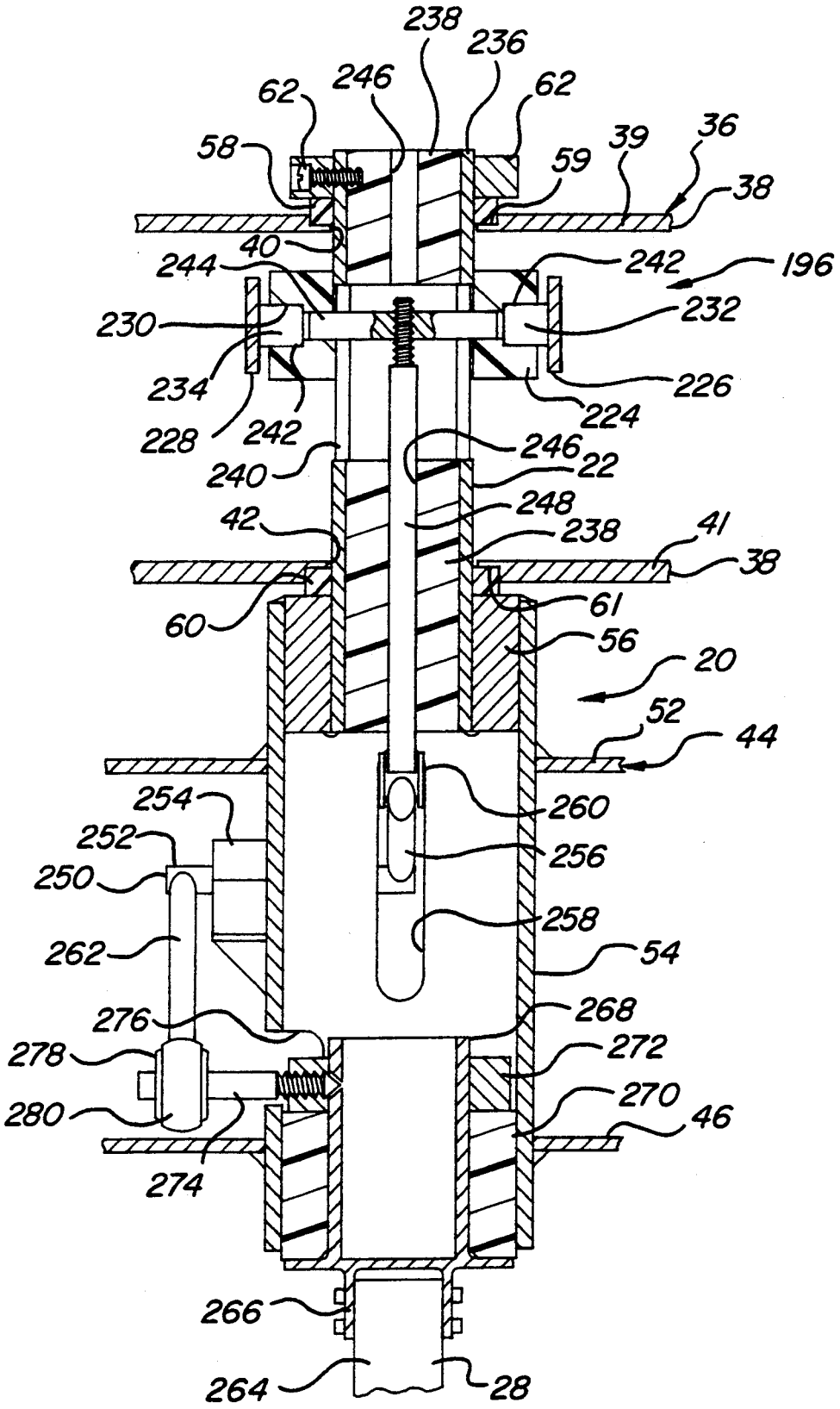
FIG. 7 is a fragmentary sectional view showing certain features of the rudder steering mechanism.

A sectional view of the assembled turret and base sections is shown in FIG. 7. The turret pedestal assembly 20 has a pyramidal base 44 formed of aluminum or other suitable rigid material and welded or otherwise fixed to the frame 16. The base 44 has a bottom wall 46 and side walls 48 projecting upwardly through an opening 50 in the platform 18 and terminating at a top wall 52. A cylindrical metal base tube 54 extends through aligned openings in the top and bottom walls of the pedestal base 44 and is welded or otherwise secured to the base 44. A portion of the base tube 54 extends above the top wall 52 and has a turret pin bushing 56 fixedly accommodated therein. A lower end of the turret pin 22 extends through a central opening of the turret pin bushing 56 and is welded or otherwise secured to the bushing 56 and hence is supported rigidly by the base tube 54. The apertures 40 and 42 of the turret bearing housing 38 have annular countersunk recesses 59 and 61 accommodating low friction, wear-resistent synthetic upper and lower bearings 56 and 60, respectively, which surround the turret pin 22 to provide low friction rotational support between the turret and base. The lower bearing 60 projects beyond the bottom wall 41 of the turret bearing housing 38 and engages the turret pin bushing 56 to support the bottom wall 41 above the base tube 54 to assist in minimizing the resistance to rotation of the turret section 12 on the pedestal assembly 20.

An upper portion of the turret pin 22 extends above the top wall 39 of the bearing housing 38 and is fitted with an annular collar 62 removably secured to the turret pin 22 by a set screw 64 or other suitable fastener to secure the turret section 12 against removal from the base section 14. The upper bearing 58 extends above the top wall 39 of the bearing housing 38 and engages the under side of the collar 62 to support the collar 62 free of the top wall 39 for assisting in the smooth, low resistance rotation of the turret section 12 on the pedestal assembly 20.

A seat 66 is mounted to the turret frame 36 rearwardly of the turret pin 22 for supporting an occupant.

The parafoil 10 is secured to the turret frame 36 by a winch assembly 70 mounted on the front end of the turret frame 36 forwardly of the turret pin 22 and opposite the seat 66. The parafoil 10 preferably comprises a stunt kite or parachute of well known construction including a maneuverable parachute-like airfoil 72 made of cloth or other suitable material. The airfoil 72 preferably has a generally rectangular configuration provided with a series of flexible shroud lines 74 that are secured about the perimeter of the airfoil 72 and converge at a connecting ring 76, which in turn is attached to one end of a single flexible load line 78. The parafoil 10 also includes control lines 80 and 82 secured to opposite sides of the airfoil 72, respectively, for enabling the operator to maneuver the parafoil 10. The control lines 80 and 82 are separate and independent of the shroud lines 74 and load line 78.

The winch assembly 70 includes a spool or drum 84 secured to a main shaft 86 which is in turn journalled by bearings 88 and 90 mounted on a pair of forwardly extending and spaced apart left and right support arms 92 and 94 of the turret frame 36 for enabling the shaft 86 and the drum 84 to rotate together relative to the arms 92 and 94 about a generally horizontal axis of the main shaft 86. The drum 84 has a pair of annular end plates 96 and a pair of annular divider plates 98 that together separate the drum 84 into three separate sections, namely, a central section 100 and a pair of side sections 102 and 104.

A roller bar 106 extends horizontally between the arms 92, 94 forwardly of the drum 92 and comprises an axle 108 fixed to the arms 92, 94 and sleeve-like roller elements 110, 112, and 114 associated with each section 100, 102, and 104 of the drum 84, respectively, and supported for rotation about the axle 108. The load line 78 and control lines 80 and 82 extend beneath the roller bar 106 and are wound counterclockwise on the drum 84, with the load line being wound about the central section 100 of the drum and the control lines 80 and 82 being wound about the remaining side sections 102 and 104 of the drum, respectively, to prevent entanglement of the individual lines. The exact length of the load line 78 and control lines 80, 82 may vary depending on the specific needs of the operator, but the drum 84 is preferably of a size capable of winding several hundred feet of line on the individual sections enabling the operator to extend the parafoil 10 far above the vessel into winds which are of higher velocity and lesser turbulence than those nearer to the surface of the water.

A foot-operated crank mechanism 116 is operatively coupled to the drum 84 for enabling the operator to control rotation of the drum 84 with his feet for selectively extending or retrieving the parafoil 10. The crank mechanism 116 comprises a crank shaft 118 extending horizontally between and journalled by a pair of upstanding spaced side walls 120 and 122 of the turret frame 36 for rotation relative thereto. The crankshaft 118 has opposite ends extending through the side walls 120 and 122 mounting a pair of bicycle-like pedals 124 and 126. A large diameter drive sprocket 128 is fixed to the crankshaft 118 outboard of the side wall 120 for rotation therewith. A relatively smaller diameter sprocket 130 is operatively coupled to the main shaft 86 of the winch 70 and interconnected with the drive sprocket 128 by a roller chain 132 for transmitting rotational motion of the crankshaft 118 to the drum 84, wherein the operator is able to rotate the drum 84 in a clockwise direction to retrieve the parafoil 10 by turning the crank pedals 124 and 126 and hence the crankshaft 118 clockwise and similarly is able to extend the parafoil 10 by turning the crank pedals 124 and 126 in a counterclockwise direction.

When extended, the wind exerts force on the airfoil 72 while, at the same time, the airfoil 72 is restrained by the shroud lines 74, the load line 78, and the control lines 80, 82 maintaining the airfoil 72 in an expanded self-supporting condition for powering the vessel. The tension on the load line 78 is transmitted to the drum 84 tending to urge the latter counterclockwise so as to unwind additional load line 78 and control lines 80 and 82. The operator could oppose such force by exerting clockwise force on the crank pedals 124 and 126, but such is not preferred as the operator would become weary.

To prevent the drum from unwinding the load line 78 and control lines 80 and 82 when tensioned, an automatic braking mechanism, indicated generally at 134, is provided which normally locks and prevents drum rotation in response to line tension unless there is overriding input from the crank mechanism 116, as will be explained below. The brake mechanism 134 includes an inner annular plate 136 and an outer annular plate 138. The inner plate 136 is fixed to a sleeve 140 that is disposed on the shaft 86 and secured by key 149 for rotation with the drum shaft 86. The sleeve 140 is secured against axial movement of the shaft 86 by a nut 142 threaded onto the end of the drum shaft 86. The outer plate 138 is fixed to the small sprocket 130 and may be formed as a single integral structure. The inner plate and sprocket unit are internally threaded and supported about an externally threaded portion 144 of the sleeve 140 having threads that extend toward the inner plate 136 in a clockwise sense, such that clockwise rotation of the outer plate and sprocket unit causes axial displacement of the outer plate 138 toward the inner plate 136, and vice versa. The nut 142 limits the outward movement of the sprocket 128.

A ratchet plate 146 is supported about the sleeve 140 between the inner and outer plates 136 and 138. A pair of friction discs 148, 150 are also supported about the sleeve 140 between the inner and outer plates 136, 138 on opposite respective sides of the ratchet plate 146. The friction discs 148 and 150 are formed of fibrous brake lining material, whereas the inner and outer plates 136 and 138 and ratchet plate 146 are formed of metal. A ratchet pawl 152 is mounted on arm 192 and biased by spring 154 into engagement with a series of circumferentially extending directional ratchet teeth 156 of ratchet plate 146 for permitting the ratchet plate 146 to rotate in a clockwise direction while locking the plate 146 against counterclockwise rotation.

Tensioning the load line 78 and control lines 80 and 82 tends to rotate the drum shaft 86 and hence the sleeve 140 counterclockwise. Slight pressure applied to the crank pedals 124 and 126 prevents rotation of the small sprocket 130 imparting relative clockwise rotation between the sleeve 140 and the outer plate 138 and sprocket 128 unit which, in turn, causes the outer plate 138 to be displaced axially toward the inner plate until such time as the friction discs 148 and 150 are brought into engagement with the ratchet plate 146 and the respective inner and outer plates 136 and 138. The friction discs 148 and 150 lock the inner and outer plates 136, 138 against further clockwise relative rotation and also lock the ratchet plate 146 against rotation relative to the inner and outer plates 136 and 138. In the locked condition, the ratchet plate 146 is coupled frictionally to the drum shaft 86. The ratchet pawl 152 prevents counterclockwise rotation of the ratchet plate 146 and locks the drum 84 against further counterclockwise rotation.

The brake mechanism 134 thus effectively isolates the crank mechanism 116 from the tension force of the load line 78 and the control lines 80 and 82 when in the locked condition, allowing the operator to remove his feet from the crank pedals 124 and 126 while maintaining the drum 84 against counterclockwise rotation. If the operator wishes to shorten the extended length of the load line 78 and control lines 80 and 82, he simply turns the crank pedals 124, 126 clockwise which rotates the ratchet plate 146 and the drum 184 clockwise winding an additional length of the load line and control lines onto the drum 84. On the other hand, if the operator wishes to increase the extended length of the load line 78 and control lines 80 and 82, he may override and unlock the automatic brake mechanism 134 by reversing the direction of the crank pedals 124, 126, which rotates the small sprocket 130 and outer plate 138 counterclockwise on the sleeve 140 relative to ratchet plate 146 and inner plate 136, causing outward axial displacement of the outer plate 138 and disengagement of the friction discs 148, 150 thereby allowing the inner plate 136 and hence the drum 84 to rotate counterclockwise so long as the operator continues to back pedal. Once the operator stops rotating the crank pedals 124, 126, the brake mechanism 134 automatically re-engages and locks as described above thereby preventing further drum rotation and extension of the load line 78 and control lines 80 and 82. The automatic brake 134 thus allows the operator to extend and retrieve the parafoil 10 while automatically holding the parafoil at any selected position without input from the operator, thereby allowing the operator to utilize his legs for other purposes, as will be explained below.

As mentioned, the control lines 80 and 82 are wound about the same drum 84 as the load line 78 and hence are extendable and retrievable in unison with the load line 78. To enable the operator to maneuver the parafoil 10 at any time when it is airborne, including during extension and retrieving of the load line 78 and control lines 80, 82, each control line is provided with a control rein 158 and 160 for controlling the extended length of the control lines 80, 82 between the airfoil 72 and the roller bar 106 independently of one another and separate from the winch 70. As shown best in FIG. 1, the control reins 158, 160 comprise separate flexible lines coupled slideably at one end to looped sections 162 and 164 of control lines 80 and 82, respectively, extending between the drum 84 and roller bar 106. The control reins 158, 160 have block and pulley members 166 and 168, respectively, secured to one end thereof and through which the looped sections 162, 164 extend for establishing a reeved connection between each control rein 158, 160 and the associated control lines 80, 82. The control reins 158, 160, in turn, are routed over a pair of block and pulley members 170 and 172, respectively, suspended from a rigging mast 174 extending above the platform 18 forwardly of the turret pin 22 and rearwardly of the drum 84. The free ends of the control reins 158 and 160 extend rearwardly toward the operator's seat 66 for grasping by the hands of the operator. By pulling on one or both control reins 158, 160, the operator is able to maneuver the parafoil 10 by adjusting the relative sizes of the looped sections 162, 164 to adjust and control the effective extended lengths of the control lines 80, 82 between the roller bar 106 and the airfoil 72, without affecting the actual extended length of the control lines between the drum 84 and the airfoil 72. This control arrangement enables the parafoil 10 to be maneuvered at all times when the parafoil is airborne, including while the parafoil is being extended and retrieved by operation of the winch 70.

The apparatus is also provided with means for landing the parafoil under the control of a single operator while maintaining the parafoil at all times out of the water. This apparatus includes parafoil landing means 176 comprising a parafoil collapsing ring 178 secured to a hand-controlled endless collapsing line 180 suspended from the rigging mast 174 by a pulley 182 and extending through an opening 184 of the mast 174. The load line 78 extends through an opening in the collapsing ring 178. During normal operation when the parafoil 10 is airborne and the lines extended, the collapsing ring 178 is maintained in an inactive lowered position illustrated in FIG. 1 so as not to interfere with the normal operation and control of the parafoil 10. However, when the operator wishes to retrieve and land the parafoil, he may do so by operating the crank mechanism 116 to wind the load line 78 and control lines 80, 82 onto the drum 84 bringing the parafoil closer to the winch 70. When the parafoil has been retrieved to the point where there are just a few yards or less of extended load line 78, the operator may land the parafoii by manipulating the collapsing line 180 to run the collapsing ring 178 up the load line 78, the shroud lines 74, and finally the airfoil, causing the parafoil to collapse and be supported above the platform 18 of the vessel and the water. See FIG. 5.

Figure 5:
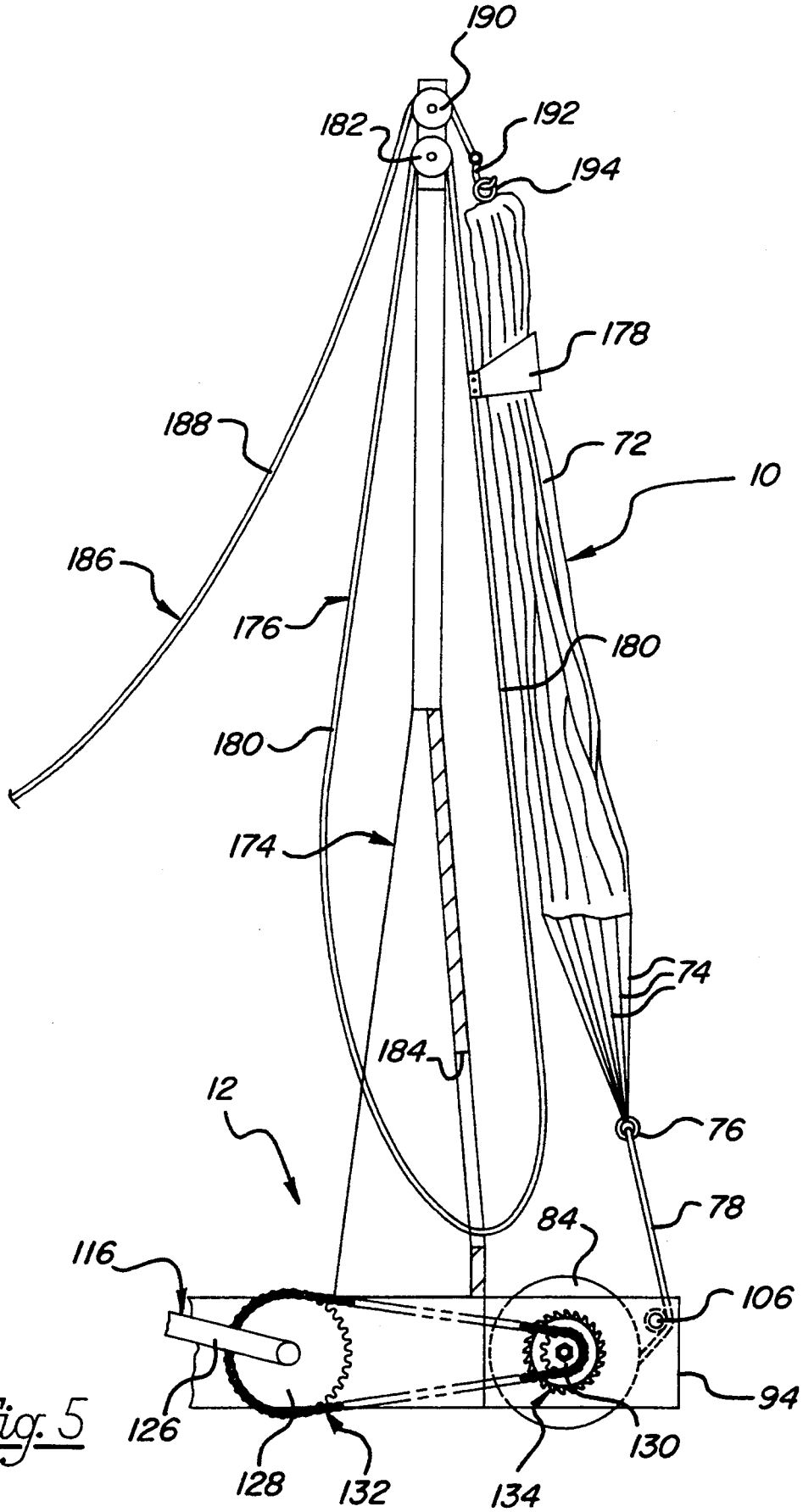
FIG. 5 is a fragmentary side view, partly in section, of the apparatus with the parafoil collapsed and stored.
Figure 6:
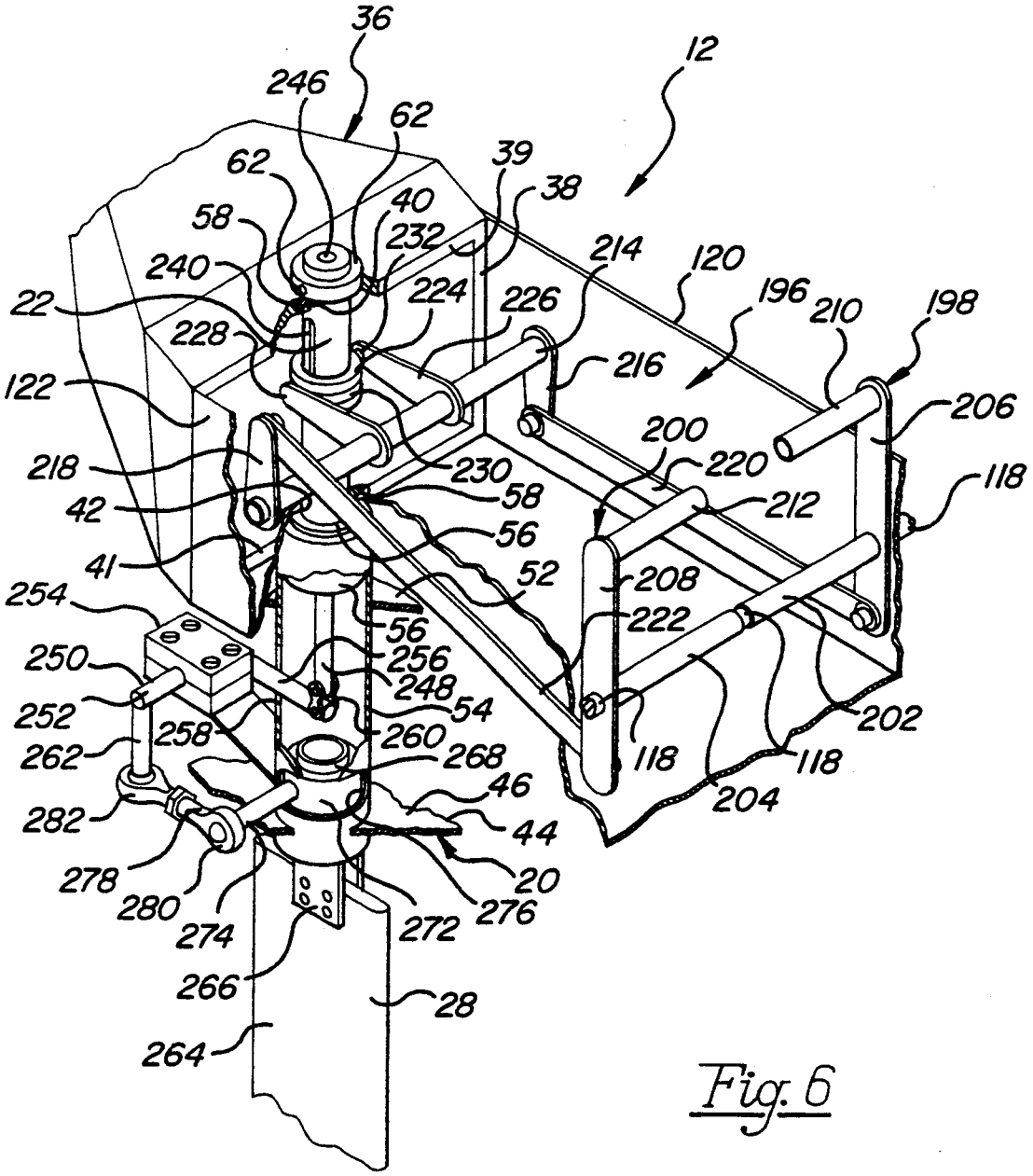
FIG. 6 is a fragmentary perspective view of the rudder steering mechanism.

The apparatus also includes hand-operated launching means 186 for enabling the operator single handedly to launch the collapsed parafoil 10 while the vessel is on the water. The launching means 186 includes a flexible launching line 188 suspended from the rigging mast 174 by a pulley 190 mounted on the rigging mast 174 adjacent the top thereof. A launching hook 192 is secured to one end of the launching line 188, whereas the other end extends rearwardly toward the seat 66 for grasping by the hands of the operator. A launching ring 194 is secured to a top of the parafoil. When the parafoil is collapsed, as shown in FIG. 5, the operator may attach the launching hook 192 to the ring 194 and thereafter tension the launching line 188 to suspend the parafoil from the launching hook 192. Once suspended by the launching hook 192, the operator may lower the collapsing ring 178 to the inoperative position of FIG. 1. The parafoil may then be launched and inflated by presenting the parafoil to the wind and slowly releasing the launching line 188. The wind acts on the airfoil 72 causing it to fill with air and become airborne and self supporting without the needed assistance of the launching hook 192. The filling of the parafoil causes the launching hook 192 to be released from the launching ring 194 and fall free of the parafoil.

Because the parafoil 10 is secured to the turret section 12 forwardly of the turret pin 22, the turret section 12 is free to rotate on the turret pin 22 in response to movements of the parafoil such that the operator is always facing the parafoil.

The apparatus also includes steering means 196 for manipulating the rudder 28 to steer the vessel. The steering means 196 includes a pair of foot-operated steering pedals 198, 200 carried by the turret frame 36. The steering pedals 198, 200 have pivot sleeve portions 202, 204 supported for rotation about the crankshaft 118 of crank mechanism 116 for enabling the pedals 198, 200 to pivot about the horizontal axis of the crankshaft 118 relative to the turret frame 36. The pedals 198, 200 have crank arms 206, 208 secured to the sleeves 202, 204 for rotation therewith and extending in axially opposite directions from the sleeves 202 and 204. The crank arms 206, 208 have foot pedals 210, 212 that are secured to an upper portion of the crank arms and extend horizontally toward one another for receiving the feet of the operator.

A transfer shaft 214 extends horizontally between and is journalled by the side walls 120, 122 of turret frame 36 at a location rearward of crankshaft 118 and adjacent turret pin 22. The transfer shaft 214 has a pair of crank arms 216, 218 secured to the shaft 214 adjacent the side walls 120 and 122 and extending from the shaft 214 in opposite axial directions. A pair of rigid push bars 220 and 222 extend between and pivotally interconnect a lower portion of the steering pedal crank arms 206 and 208 and the crank arms 216 and 218 of transfer shaft 214, respectively, so that pivoting the steering pedals 198, 200 in a first direction about crankshaft 118 (i.e., with one of the steering pedals pivoted forwardly and the other pivoted rearwardly) causes the transfer shaft 214 to rotate in one direction, whereas reversing the pivotal movement of steering pedals causes the transfer shaft 214 to rotate in an opposite direction.

The rotary movement of the transfer shaft 214 is transmitted to a transfer slide or collar 224 which is carried about the turret pin 22 and slideable vertically therealong. A pair of transfer fingers 224, 226 are secured to transfer shaft 214 between the crank arms 216, 218 and project radially outwardly therefrom toward the turret pin 22 on opposite sides of the transfer slide 224. As shown best in FIG. 7, the transfer slide 224 has an annular groove 230 accommodating a pair of finger studs 232, 234 projecting inwardly of the transfer fingers 226, 228. The finger studs 232, 234 engage the walls of the groove 230 on rotation of the transfer fingers 226, 228 to translate the rotary movements of the fingers 226, 228 into longitudinal sliding movement of the transfer slide 224. Since the transfer shaft 214 is journalled by the turret frame 36, the transfer shaft 214 and the transfer fingers 226, 228 are rotatable with the turret frame 36 in relation to the turret pin 22. The finger studs 232, 234, however, maintain a position within the groove 230 of transfer slide 224 during rotation of the turret frame 36 enabling the operator to control steering movements of the rudder irrespective of the rotational position of the turret frame 36 on the base section 14.

The turret pin 22 has a metal outer cylindrical tubular shell 236 and a synthetic core 238 of low friction, wear-resistant material. The turret pin 22 is formed with an elongate through slot 24Q extending transversely through and lengthwise of the turret pin 22 along the travel of the transfer slide 224. The transfer slide 224 is formed with a pair of transversely aligned apertures 242. A slide pin 244 extends horizontally across the slot 240 and has ends which are accommodated in the apertures 242 so as to be carried with the transfer slide 224 allowing free sliding movements of the transfer slide 224 along the length of the slot 240 while restraining the transfer slide 224 against rotational movement about the turret pin 22.

The core 238 has a central bore 246 extending longitudinally along the vertical axis of the turret pin 22. The bore 246 slideably accommodates a rigid steer rod 248 that is threadedly secured at its upper end to the slide pin 244 for movement with transfer slide 224. The lower end of the steer rod 248 extends into the base tube 54. A steering crank 250 has a horizontal shaft 252 journalled in a clamping block 254 mounted on the base tube 54. The steering crank 250 has a first crank arm 256-extending through an elongate slot-like opening 258 of base tube 54 the free end of which is coupled pivotally to the lower end of the steering rod 248 by a connecting link 260. A second crank arm 262 of the steering crank 250 projects radially downward from the shaft 252 so that the translational motion of the steering rod 248 is transmitted into swinging pivotal movement of the second arm 262 in a generally vertical plane.

The rudder 28 includes a blade-like waterfoil member 264 mounted by a foil housing 266 which is in turn secured to a cylindrical rudder post 268 extending into the base tube 54 through the bottom thereof. A synthetic rudder bearing 270 is accommodated within the base tube 54 and surrounds the rudder post 268 enabling the rudder post 268 to rotate with low friction relative to the base tube 54 about a generally vertical axis of the rudder post 268. A tiller collar 272 is removable secured to an upper portion of the rudder post 268 by a tiller arm 274 that is threaded into the collar 272 and projects horizontally outward therefrom through an associated slot opening 276 in the base tube 54. The tiller arm 274 is connected to the second arm 262 of the steering crank 250 by a rigid connecting rod 278 extending between the tiller arm 274 and second crank arm 262 and secured to each by ball and socket end connections 280 and 282, respectively, such that the swinging pivotal movement of the second crank arm 262 is transmitted into axial rotation movement of the rudder 28 for maneuvering the vessel.

The disclosed embodiment is representative of the preferred form of the invention, but is intended to be illustrative rather than definitive thereof. The invention is defined in the claims.

I claim:

1. A wind-powered sailing apparatus, comprising:
a hull;
an air-inflatable parafoil having load and control lines connected to said parafoil for extending, retrieving, and maneuvering said parafoil;
line length adjustment means carried by said hull and connected to said lines for adjusting the length of said lines between said hull and said parafoil;
parafoil maneuvering means engaging said control lines for enabling a user selectively to alter the effective length of said control lines independently of one another for steering said parafoil; and
parafoil collapsing means carried by said hull for collapsing and supporting said parafoil when retrieved.

2. The apparatus of claim 1 wherein said parafoil collapsing means comprises a collapsing ring having an opening through which said load line extends, said collapsing ring being supported for movement along said load line and around said parafoil for collapsing said parafoil when retrieved.

3. The apparatus of claim 2 wherein said parafoil collapsing means includes a hand-operated collapsing line secured to said collapsing ring.

4. The apparatus of claim 1 including launching means carried by said hull and detachably connectable to said parafoil when collapsed for holding said collapsed parafoil in a position to be filled with air by the wind.

5. The apparatus of claim 4 wherein said launching means includes a hand-operated launching line movable independently of said load line and carrying a launching hook for separable attachment to a launching ring secured to said parafoil.

6. The apparatus of claim 4 wherein said hull includes an upstanding rigging mast supporting said parafoil collapsing means and said launching means.

7. The apparatus of claim 1 wherein said line length adjustment means comprises a winch having a rotatable drum on which said load line is wound.

8. The apparatus of claim 7 wherein said winch includes foot-operated pedal crank mechanism operatively coupled to said drum for controlling rotation of said drum in one direction to extend said load line and in the opposite direction to retrieve said load line.

9. The apparatus of claim 8 wherein said winch includes automatic braking means for normally preventing drum rotation in said first direction when said load line is tensioned, said pedal crank mechanism being operative to override and release said automatic braking means and enable rotation of said drum in said first direction.

10. The apparatus of claim 6 wherein said control lines are wound about said winch drum and are extendable and retrievable in unison with said load line by operation of said winch, said parafoil maneuvering means including control reins slidingly engaging said control lines, said control reins being bodily extendable and retractable independently of one another for adjusting the relative effective extended lengths of said control lines to maneuver said parafoil.

11. The apparatus of claim 10 wherein said winch has a horizontal roller bar mounted in spaced relationship to said drum, said control lines extending beneath said roller bar, said control lines each having a loop formed in the section of line between said drum and said roller bar, said control reins engaging said loops such that controlled adjustment of said reins produces a corresponding adjustment in the relative size of said loops sections and in the relative control line length between said roller bar and said parafoil to maneuver said parafoil.

12. The apparatus of claim 1 wherein said hull has a mobile base section and a turret section mounted for free rotation on said base section, said turret section including a seat for supporting an occupant.

13. The apparatus of claim 12 wherein said hull comprises a pair of laterally spaced hull sections mounted rigidly on a frame, and a free-castering castering front hull pivotally connected to said frame between said hull sections.

14. The apparatus of claim 13 wherein said hull includes steering means.

15. The apparatus of claim 14 wherein said steering means comprises a rudder pivotally mounted on said frame, foot-operated steering controls carried by said turret, and motion transmitting linkage means interconnecting said foot controls and said rudder for translating force applied to said foot controls to said rudder to control steering movement of said rudder.

16. The apparatus of claim 15 wherein said base section has a turret pin on which said turret is mounted for rotation about a vertical axis of said turret pin.

17. The apparatus of claim 16 wherein said foot-operated controls comprise a pair of steering pedals supported for conjoint movement in opposite fore and aft directions relative to one another, said turret pin having a central passageway, and said motion transmitting means extending through said passageway.

18. The apparatus of claim 17 wherein said steering pedals are journalled about a horizontal shaft for rotary movements in opposite directions relative to one another, and including a horizontal transfer shaft spaced rearwardly of said steering pedal shaft and rotatable relative to said turret, a pair of crank arms projecting radially from said transfer shaft in opposite directions, a pair of push bars extending between and pivotally interconnecting associated said steering pedals and said crank arms to rotate said transfer arm in a first direction in response movement of said steering pedals in one relative direction and in a second direction in response to opposite relative movement of said steering pedals, a transfer slide supported for vertical sliding movement about said turret pin, a pair of transfer arms projecting radially from said transfer shaft and engaging said transfer slide to displace said transfer slide vertically in response to rotation of said transfer shaft, a steering rod coupled to said transfer slide and accommodated within said passageway of said turret pin for translational displacement with said transfer slide, a steering crank coupled to said steering rod and supported for rotation about a horizontal axis in response to displacement of said steering rod, and a tiller arm secured to said rudder and coupled to said steering crank for rotating said rudder about a vertical axis in response to rotational movement of said steering crank.

19. A wind-powered sail boat comprising:
a hull;
a parafoil for driving said hull;
flexible load and control lines connected to said parafoil for extending, retrieving, and maneuvering said parafoil;
line length adjustment means connected to said lines for adjusting the length of said lines between said hull and said parafoil;

means engaging said control lines for altering the effective length of said control lines between said parafoil and said hull independently of one another for manipulating said parafoil;

parafoil landing means carried by said hull for landing and supporting said parafoil when retrieved; and parafoil launching means removably engaging said parafoil for suspending said parafoil when landed and presenting said parafoil in a position to be filled with wind for launching said parafoil.

20. The apparatus of claim 19 wherein said means engaging said control lines comprises a pair of hand-operated control reins.

21. The apparatus of claim 19 wherein said line length adjustment means comprises a foot-operated winch.

22. The apparatus of claim 19 wherein said parafoil landing means comprises a collapsing ring supported for movement along said load line and about said parafoil when retrieved for collapsing and supporting said parafoil.

23. The apparatus of claim 19 wherein said hull has a base and a turret supported for rotation on said base and mounting said line length adjustment means, said parafoil landing means, said means engaging said control lines, and said parafoil launching means.

24. The apparatus of claim 23 wherein said hull has steering means including foot-operated controls carried by said turret, a rudder mounted for pivotal movements on said base, and motion transmitting linkage mechanism interconnecting said foot-operated controls and said rudder.

25. The apparatus of claim 19 wherein said hull includes a pair of laterally spaced, fixed hull sections and a free castering hull section between said hull sections.

26. A wind-powered sailing apparatus comprising:

a hull;

an air-inflatable parafoil having a series of converging flexible shroud lines and a flexible load line connected at one end to said shroud lines;

line length adjustment means carried by said hull and connected to an opposite end of said load line for selectively extending and retrieving said parafoil in relation to said hull, said line length adjustment means comprising a winch having a rotatable drum on which said load line is wound;

parafoil collapsing means carried by said hull for collapsing and supporting said parafoil when retrieved; and wherein said parafoil includes control lines wound about said winch drum and extendable and retrievable in unison with said load line by operation of said winch, said control lines including control reins slidingly engaging said control lines, said control reins being bodily extendable and retractable independently of one another for adjusting the relative effective extended lengths of said control lines to maneuver said parafoil.

* * * * *

UNITED STATES PATENT AND TRADEMARK OFFICE

CERTIFICATE OF CORRECTION

PATENT NO. : 5,355,817

DATED : October 18, 1994

INVENTOR(S) : James M. Schrems

It is certified that error appears in the above-indentified patent and that said Letters Patent is hereby corrected as shown below:

Column 6, line 57, change "parafoii" to -- parafoil --.

Column 8, line 16, change "24Q" to -- 240 --.

Column 10, line 12, cancel "castering" (second occurrence).

Signed and Sealed this

Third Day of January, 1995

*Attest:*

Bruce Lehman

BRUCE LEHMAN

*Attesting Officer*

*Commissioner of Patents and Trademarks*